US007312011B2

(12) United States Patent
Patel et al.

(10) Patent No.: US 7,312,011 B2
(45) **Date of Patent: *Dec. 25, 2007**

(54) SUPER LOW MELT AND ULTRA LOW MELT TONERS CONTAINING CRYSTALLINE SULFONATED POLYESTER

(75) Inventors: Raj D. Patel, Oakville (CA); Edward G. Zwartz, Mississauga (CA); Guerino G. Sacripante, Oakville (CA); Allan K. Chen, Oakville (CA)

(73) Assignee: Xerox Corporation, Norwalk, CT (US)

( * ) Notice: Subject to any disclaimer, the term of this patent is extended or adjusted under 35 U.S.C. 154(b) by 386 days.

This patent is subject to a terminal disclaimer.

(21) Appl. No.: 11/037,214

(22) Filed: Jan. 19, 2005

(65) Prior Publication Data

US 2006/0160010 A1 Jul. 20, 2006

(51) Int. Cl.
*G03G 9/087* (2006.01)

(52) U.S. Cl. ..... 430/109.4; 430/137.14

(58) Field of Classification Search ..... 403/109.4, 403/111.4, 137.4
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 4,254,207 | A | 3/1981 | Landoll et al. |
| 4,298,672 | A | 11/1981 | Lu |
| 4,338,390 | A | 7/1982 | Lu |
| 4,952,477 | A | 8/1990 | Fuller et al. |
| 4,990,424 | A | 2/1991 | Van Dusen et al. |
| 5,057,392 | A | 10/1991 | McCabe et al. |
| 5,147,747 | A | 9/1992 | Wilson et al. |
| 5,166,026 | A | 11/1992 | Fuller et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,346,797 | A | 9/1994 | Kmiecik-Lawrynowics et al. |
| 5,364,729 | A | 11/1994 | Kmiecik-Lawrynowicz et al. |
| 5,370,963 | A | 12/1994 | Patel et al. |
| 5,418,108 | A | 5/1995 | Kmiecik-Lawrynowica et al. |
| 5,593,807 | A | 1/1997 | Sacripante et al. |
| 5,916,725 | A | 6/1999 | Patel et al. |
| 6,168,894 | B1 | 1/2001 | Aoki et al. |
| 6,214,507 | B1 | 4/2001 | Sokol et al. |
| 6,335,137 | B1 | 1/2002 | Suzuki et al. |
| 6,383,705 | B2 | 5/2002 | Aoki et al. |
| 6,413,691 | B2 | 7/2002 | Daimon et al. |
| 6,821,698 | B2 | 11/2004 | Sawada et al. |
| 2002/0018952 | A1* | 2/2002 | Daimon et al. ..... 430/109.4 |
| 2002/0106573 | A1* | 8/2002 | Hamano et al. ..... 430/109.4 |
| 2003/0027073 | A1* | 2/2003 | Serizawa et al. ..... 430/109.4 |
| 2003/0039910 | A1 | 2/2003 | Shirai et al. |
| 2003/0104296 | A1* | 6/2003 | Hamano et al. ..... 430/109.4 |
| 2004/0137350 | A1* | 7/2004 | Yamazaki et al. ..... 430/109.4 |
| 2004/0142266 | A1* | 7/2004 | Sacripante et al. ..... 430/109.4 |
| 2004/0161687 | A1* | 8/2004 | Kim et al. ..... 430/109.4 |
| 2005/0074685 | A1* | 4/2005 | Kido et al. ..... 430/109.4 |
| 2006/0063086 | A1* | 3/2006 | Sacripante et al. ..... 430/109.4 |
| 2006/0088779 | A1* | 4/2006 | Sacripante et al. ..... 430/109.4 |
| 2006/0115758 | A1* | 6/2006 | Chang et al. ..... 430/109.4 |
| 2006/0292475 | A1* | 12/2006 | Veregin et al. ..... 430/109.4 |

* cited by examiner

*Primary Examiner*—Christopher RoDee
(74) *Attorney, Agent, or Firm*—Oliff & Berridge, PLC

(57) ABSTRACT

A toner is disclosed that includes a toner binder of crystalline sulfonated polyester, wherein the crystalline sulfonated polyester is 90% by weight or more of the toner binder, and a colorant. In other embodiments, the toner includes a crystalline sulfonated polyester and a linear amorphous sulfonated polyester, and a colorant. In these embodiments, the crystalline sulfonated polyester is from about 20% to about 60% by weight of the toner binder and the linear amorphous sulfonated polyester is from about 40% to about 80% by weight of the toner binder. The toners possess excellent miniumum fixing temperatures in the range of from about 80° C. to about 130° C. Processes for preparing the toners are also described.

12 Claims, No Drawings

SUPER LOW MELT AND ULTRA LOW MELT TONERS CONTAINING CRYSTALLINE SULFONATED POLYESTER

BACKGROUND

The present disclosure relates generally to a toner comprising a binder and at least one colorant, wherein the binder is comprised entirely of crystalline sulfonated polyester or includes crystalline sulfonated polyester along with a linear amorphous sulfonated polyester and optionally a branched sulfonated polyester. Additionally, the present exemplary embodiments relate to processes for forming such toner compositions. This disclosure finds particular application in conjunction with xerographic or electrostatographic printing processes, and will be described with particular reference thereto. However, it is to be appreciated that the present exemplary embodiments are also amenable to other like applications.

Xerographic toners of a resin, a pigment, and a charge control agent are known. Toners useful for xerographic applications should exhibit certain performances related to storage stability, and particle size integrity, that is, it is desired to have the particles remain intact and not agglomerate until they are fused on paper. Since environmental conditions vary, the toners also should not substantially agglomerate up to a temperature of from about 50° C. to about 55° C. The toner composite of resins and colorant should also display acceptable triboelectrification properties that vary with the type of carrier or developer composition.

Another desirable property for xerographic toner compositions to possess is fusing property on paper. Due to energy conservation measures, and more stringent energy characteristics placed on xerographic engines, such as on xerographic fusers, there is pressure to reduce the fixing temperatures of toners onto paper, such as achieving fixing temperatures of from about 90° to about 120° C., to permit less power consumption and allowing the fuser system to possess extended lifetimes. For a noncontact fuser, that is a fuser that provides heat to the toner image on paper by radiant heat, the fuser usually is not in contact with the paper and the image. For a contact fuser, that is a fuser which is in contact with the paper and the image, the toners should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Fixing performance of a toner can be characterized as a function of temperature. The maximum temperature at which the toner does not adhere to the fuser roll is called the hot offset temperature (HOT). When the fuser temperature exceeds HOT, some of the molten toner adheres to the fuser roll during fixing and is transferred to subsequent substrates containing developed images, resulting for example in blurred images. This undesirable phenomenon is called offsetting. Less than the HOT of the toner is the minimum fixing temperature (MFT) of the toner, which is the minimum temperature at which acceptable adhesion of the toner to the support medium occurs, that is, as determined by, for example, a crease test. The difference between MFT and HOT is called the fusing latitude of the toner, i.e., the temperature difference between the fixing temperature and the temperature at which the toner offsets onto the fuser. The fusing latitude should be as large as possible.

For oil containing fuser rolls, the toner compositions may not contain a wax. For fusers without oil on the fuser (usually hard rolls), however, the toner composites will usually contain a lubricant like a wax to provide release and stripping properties. Additionally, depending on the xerographic applications, other toner characteristics may be desired, such as providing high gloss images, especially in pictorial color applications.

Additionally, small sized toner particles, such as having average particle sizes of from about 3 to about 12 microns, and preferably from about 5 to about 7 microns, are desired, especially in xerographic engines wherein high resolution is a characteristic. Toners with the aforementioned small sizes can be economically prepared by chemical processes, which involves the direct conversion of emulsion sized particles to toner composites by aggregation and coalescence, or by suspension, microsuspension or microencapsulation processes.

Low fixing toners comprised of semicrystalline resins are known, such as those disclosed in U.S. Pat. No. 5,166,026, and wherein toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of semicrystalline polyolefin and copolymers thereof with a melting point of from about 50° C. to about 100° C., and containing functional groups comprising hydroxy, carboxy, amino, amido, ammonium or halo, and pigment particles, are disclosed. Although, it is indicated that some of these toners may provide low fixing temperatures of about 200° F. to about 225° F. using contact fusing applications, the resins are derived from components with melting characteristics of about 30° C. to about 50° C., and which resins are not believed to exhibit more desirable melting characteristics, such as about 55° C. to about 60° C.

In U.S. Pat. No. 4,990,424, toners comprised of a blend of resin particles containing styrene polymers or polyesters, and components selected from the group consisting of semicrystalline polyolefin and copolymers thereof with a melting point of from about 50° C. to about 100° C. are disclosed. Fusing temperatures of from about 250° F. to about 330° F. are reported.

Low fixing crystalline based toners are disclosed in U.S. Pat. No. 6,413,691, and wherein a toner comprised of a binder resin and a colorant, the binder resin containing a crystalline polyester containing a carboxylic acid of two or more valences having a sulfonic acid group as a monomer component, are illustrated. The crystalline resins of the '691 patent are believed to be opaque, resulting in low projection efficiency.

Crystalline based toners are disclosed in U.S. Pat. No. 4,254,207. Low fixing toners comprised of crosslinked crystalline resin and amorphous polyester resin are illustrated in U.S. Pat. No. 5,147,747 and U.S. Pat. No. 5,057,392, and wherein the toner powder is comprised, for example, of polymer particles of partially carboxylated crystalline polyester and partially carboxylated amorphous polyester that has been crosslinked together at elevated temperature with the aid of an epoxy novolac resin and a crosslinking catalyst.

U.S. Pat. No. 5,916,725 describes a process for the preparation of toner comprising mixing an amine, an emulsion latex containing sulfonated polyester resin, and a colorant dispersion, heating the resulting mixture, and optionally cooling.

Illustrated in U.S. Pat. No. 5,593,807, the disclosure of which is totally incorporated herein by reference in its entirety, is a process for the preparation of toner compositions comprising, for example, (i) preparing an emulsion latex comprised of sodio sulfonated polyester resin particles of from about 5 to about 500 nanometers in size diameter by heating the resin in water at a temperature of from about 65° C. to about 90° C.; (ii) preparing a pigment dispersion in water by dispersing in water from about 10 to about 25 weight percent of sodio sulfonated polyester and from about 1 to about 5 weight percent of pigment; (iii) adding the pigment dispersion to the latex mixture with shearing, followed by the addition of an alkali halide in water until aggregation results as indicated, for example, by an increase in the latex viscosity of from about 2 centipoise to about 100 centipoise; (iv) heating the resulting mixture at a temperature of from about 45° C. to about 55° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying. The sulfonated polyesters of this patent may be selected for use in embodiments of the present invention.

Emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108, 5,364,729, and 5,346,797.

There is thus a need to provide super low melt and ultra low melt toners that may be used at lower fusing temperatures and that still provide excellent image properties. There is thus also a need to provide a process for preparing such low melt emulsion aggregation toners that allows for controlled particle growth and controlled morphology or shape, and provides high yields.

SUMMARY

In embodiments, toners comprised substantially of crystalline sulfonated polyester, a colorant and optionally a wax are provided.

In embodiments, toners comprised of crystalline sulfonated polyester along with a linear amorphous sulfonated polyester and optionally a branched sulfonated polyester, a colorant and optionally a wax are provided.

Moreover, the toners of the invention exhibit low minimum fixing temperatures, such as from about 80° C. to about 130° C. Further, the toners have a superior fusing latitude, in particular of 100° C. or more.

In a still further embodiment, a developer comprising the toners of embodiments and a carrier is achieved.

In still further embodiments, processes of forming the toners are described. For example, a process for preparing the toner may comprise forming an emulsion comprising submicron crystalline sulfonated polyester particles, mixing a colorant, and optionally a wax, with the emulsion, adding an aggregating agent to the mixture, wherein the aggregating agent comprises a multivalent salt or a divalent salt, aggregating the mixture to form toner particles, wherein the crystalline sulfonated polyester comprises 90% by weight or more of the toner's binder, and coalescing the toner particles to form coalesced toner particles having an average particle size of about 6 to about 11 microns.

Further, a process for preparing the toner may comprise forming an emulsion comprising both a linear amorphous sulfonated polyester resin and a crystalline sulfonated polyester resin, forming a mixture by adding a colorant and optionally a wax to the emulsion, homogenizing the pre-toner mixture, adding an aggregating agent to the pre-toner mixture and aggregating the mixture to form aggregated toner particles, and coalescing the aggregated toner particles to form coalesced toner particles having an average particle size of about 7 to about 11 microns.

DETAILED DESCRIPTION OF EMBODIMENTS

In a first embodiment, the toner includes a binder comprised substantially of crystalline sulfonated polyester. In this regard, the crystalline sulfonated polyester in this embodiment comprises at least 90% by weight, and preferably at least 95% by weight, and most preferably at least 98%, by weight of the toner binder.

Crystalline sulfonated polyester, as used herein, refers to a sulfonated polyester polymer having a three dimensional order. By crystalline is meant that the sulfonated polyester has some degree of crystallinity, and thus crystalline is intended to encompass both semicrystalline and fully crystalline sulfonated polyester materials. The polyester is considered crystalline when it is comprised of crystals with a regular arrangement of its atoms in a space lattice.

Upon aggregation and coalescence, the toner particles comprised substantially of crystalline sulfonated polyester have an average particle size of about 4 to about 15 microns, preferably about 6 to about 11 microns, with a geometric size distribution (GSD) of about 1.20 to about 1.35. Herein, the geometric size distribution is defined as the square root of D84 divided by D16. The particles have a relatively smooth particle morphology, and significantly, when fused using a heated fuser roll, exhibit a minimum fixing temperature (MFT) of about 80° C. to about 130° C., most preferably about 90° C., with a fusing latitude of over 100° C. The gloss exhibited by the toner is stable across the fusing temperature range, being about 30 to about 50 Gardner gloss units (ggu), preferably about 40 ggu, at low fusing temperatures and the being maintained at such levels throughout the whole fusing temperature range (e.g., a fusing temperature range of from about 100° C. to about 215° C.). The gloss is somewhat lower compared to other commercially available toners because, as detailed below, the aggregation of the crystalline sulfonated polyester is typically effected using a multivalent ion coagulant such as polyaluminum chloride (PAC), which tends to promote crosslinking of the material and thereby reduce gloss to some extent.

While the aforementioned toner comprised substantially of crystalline sulfonated polyester binder exhibits excellent properties, it is presently expensive to manufacture. Further, crystalline polyester toners are generally difficult to make by conventional methods since they are very difficult to jet due to the brittleness. This is one of the reasons why a chemical route is very appealing, although the material cost is expensive. Thus, in reducing the cost yet still achieving a toner with excellent properties, in another embodiment of the invention, the toner includes a binder comprised of crystalline sulfonated polyester along with a linear amorphous sulfonated polyester and optionally a branched sulfonated polyester.

In this embodiment, the binder is comprised of about 20 to about 60% by weight, preferably about 20 to about 45% by weight of the binder, crystalline sulfonated polyester, and about 40% to about 80% by weight, preferably about 55% to about 80% by weight of the binder, linear amorphous sulfonated polyester.

Further, portions of the linear amorphous polyester may be replaced in the binder with branched amorphous sulfonated polyester. Branched herein refers to a polymer with chains linked to form a crosslinked network. For example, up to 80% by weight of the linear amorphous sulfonated polyester may be replaced with a branched amorphous sulfonated polyester, if desired. The inclusion of branched polyester portions may be used to impart elasticity to the binder, which improves the toner offset properties while not substantially affecting the minimum fixing temperature (MFT).

Upon aggregation and coalescence, the toner of this embodiment in which the binder is comprised of crystalline sulfonated polyester and linear amorphous sulfonated polyester and/or branched amorphous sulfonated polyester has an average particle size of about 4 to about 15 microns, preferably about 7 to about 11 microns, with a GSD of about 1.10 to about 1.25. The particles have a relatively smooth particle morphology, and when fused using a heated fuser roll, exhibit a MFT of about 100° C. to about 130° C., preferably about 110° C., and a fusing latitude well over 100° C. The gloss exhibited by the toner may range from about 20 ggu at 100° C. to about 50 ggu at about 125° C. With the incorporation of branched sulfonated polyester in the toner formulation, e.g., up to about 80% by weight of the binder, the MFT of the toner is increased, e.g., to range from about 120° C. to about 130° C., and the gloss is slightly decreased.

The components of the toners of the various embodiments will now be described. In embodiments, the crystalline, linear amorphous and branched amorphous sulfonated polyester materials of the binder may each be the same or different.

In embodiments, the crystalline, linear amorphous and branched amorphous sulfonated polyester resins are each alkali sulfonated polyester resins. The alkali metal in the respective sulfonated polyester resins may independently be lithium, sodium, or potassium.

In general, the sulfonated polyesters may have the following general structure, or random copolymers thereof in which the n and p segments are separated.

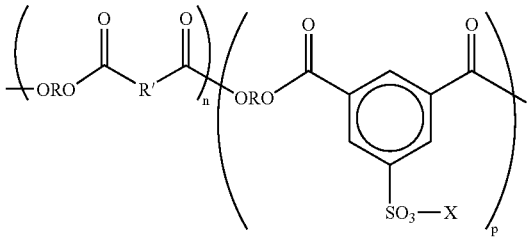

wherein R is an alkylene of, for example, from 2 to about 25 carbon atoms such as ethylene, propylene, butylene, oxyalkylene diethyleneoxide, and the like; R' is an arylene of, for example, from about 6 to about 36 carbon atoms, such as a benzylene, bisphenylene, bis(alkyloxy) bisphenolene, and the like; and p and n represent the number of randomly repeating segments, such as for example from about 10 to about 100,000.

Examples of amorphous alkali sulfonated polyester based resins include, but are not limited to, copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly (propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion. Examples of crystalline alkali sulfonated polyester based resins alkali copoly(5-sulfoisophthaloyl)-co-poly(ethylene-adipate), alkali copoly(5-sulfoisophthaloyl)-copoly(propylene-adipate), alkali copoly (5-sulfoisophthaloyl)-copoly(butylene-adipate), alkali copoly(5-sulfo-isophthaloyl)-copoly(pentylene-adipate), and alkali copoly(5-sulfo-iosphthalbyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly (propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly (butylene-adipate), alkali copoly(5-sulfo-isophthaloyl)-copoly(pentylene-adipate), alkali copoly(5-sulfo-isophthaloyl)copoly(hexylene-adipate), poly(octylene-adipate), and wherein the alkali is a metal like sodium, lithium or potassium. In embodiments, the alkali metal is lithium.

The crystalline resin can possess various melting points of, for example, from about 30° C. to about 120° C., and preferably from about 50° C. to about 90° C. The crystalline resin may have, for example, a number average molecular weight (Mn), as measured by gel permeation chromatography (GPC) of, for example, from about 1,000 to about 50,000, and preferably from about 2,000 to about 25,000. The weight average molecular weight (Mw) of the resin may be, for example, from about 2,000 to about 100,000, and preferably from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resins can be prepared by the polycondensation process of reacting suitable organic diol(s) with suitable organic diacid(s) or diester(s), at least one of which is sulfonated or at least one further difunctional sulfonated monomer being included in the reaction, in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. When organic diesters are used in place of organic diacids, an alcohol byproduct should be generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride, thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

The linear and branched amorphous polyester resins, in embodiments, possess, for example, a number average molecular weight (Mn), as measured by GPC, of from about 10,000 to about 500,000, and preferably from about 5,000 to about 250,000; a weight average molecular weight (Mw) of, for example, from about 20,000 to about 600,000, and preferably from about 7,000 to about 300,000, as determined by GPC using polystyrene standards; and a molecular weight distribution (Mw/Mn) of, for example, from about 1.5 to about 6, and more specifically, from about 2 to about 4.

The linear amorphous polyester resins are generally prepared by the polycondensation of an organic diol and a diacid or diester, at least one of which is sulfonated or a sulfonated difunctional monomer being included in the reaction, and a polycondensation catalyst. For the branched amorphous sulfonated polyester resin, the same materials may be used, with the further inclusion of a branching agent such as a multivalent polyacid or polyol.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected can vary, and more specifically, is, for example, from about 45 to about 52 mole percent of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methyl-pentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 weight percent of the resin can be selected.

Branching agents for use in forming the branched amorphous sulfonated polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

In addition to the aforementioned toner binders, the toner includes at least one colorant. Various known suitable colorants, such as dyes, pigments, and mixtures thereof, may be included in the toner in an effective amount of, for example, about 1 to about 25 percent by weight of the toner, and preferably in an amount of about 1 to about 15 weight percent. As examples of suitable colorants, which is not intended to be an exhaustive list, mention may be made of carbon black like REGAL 330®; magnetites, such as Mobay magnetites MO08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340-(BASF), and Lithol Fast Scarlet L4300 (BASF).

Optionally, the toner compositions may also include a wax. When included, the wax is preferably present in an amount of from about, for example, 1 weight percent to about 25 weight percent, preferably from about 5 weight percent to about 20 weight percent, of the toner. Examples of suitable waxes include, but are not limited to polypropylenes and polyethylenes commercially available from Allied Chemical and Petrolite Corporation (E.G., POLYWAX™ polyethylene waxes from Baker Petrolite), wax emulsions available from Michaelman, Inc. and the Daniels Products Company, EPOLENE N-15™ commercially available from Eastman Chemical Products, Inc., VISCOL 550-P™, a low weight average molecular weight polypropylene available from Sanyo Kasei K. K., CARNUBA Wax and similar materials. Examples of functionalized waxes include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson wax.

The toners of embodiments may also contain other optional additives, as desired or required. For example, the toner may include positive or negative charge enhancing additives, preferably in an amount of about 0.1 to about 10, and more preferably about 1 to about 3, percent by weight of the toner. Examples of these additives include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

There can also be blended with the toner compositions external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof. Each of the external additives may be present in an amount of from about 0.1 percent by weight to about 5 percent by weight, and more specifically, in an amount of from about 0.1 percent by weight to about 1 percent by weight, of the toner. Several of the aforementioned additives are illustrated in U.S. Pat. Nos. 3,590,000, 3,800,588, and 6,214,507, the disclosures which are totally incorporated herein by reference.

The toners may be made by a variety of known methods. Most preferably, however, the toners are made by the well known aggregation and coalescence process in which small size resin particles are aggregated to the appropriate toner particle size and then coalesced to achieve the final toner particle shape and morphology.

The toners may be prepared by a process that includes aggregating a mixture of a colorant, optionally a wax and any other desired or required additives, and emulsion(s) comprising the sulfonated polyester binder resin(s), and then coalescing the aggregate mixture. A pre-toner mixture is prepared by adding the colorant, and optionally a wax or other materials, to the emulsion, which may be a mixture of two or more emulsions containing the toner binder resin. In embodiments, the pH of the pre-toner mixture is adjusted to between about 4 to about 5. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA Ultra Turrax T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent is added to the pre-toner mixture at a temperature that is below the glass transition temperature ($T_g$) of the emulsion resin. Preferably, the aggregating agent is added in an amount of about 0.05 pph to about 3.0 pph with respect to multivalent cation and from about 1.0 to about 10 pph with respect to the divalent cation wherein the pph is with respect to weight of toner. The aggregating agent may be added to the pre-toner mixture over a period of from about 0 to about 60 minutes. Aggregation may be accomplished with or without maintaining homogenization. Aggregation is accomplished at temperatures that are preferably greater then 60° C.

In embodiments, although either a multivalent salt such as polyaluminum chloride or a divalent salt such as zinc acetate may be used, and the toner formulations may be identical for both aggregating agents, the process of preparing the toner particles is different. A divalent cation material is preferably used when the toner binder includes both linear amorphous and crystalline sulfonated polyesters. In the case of the multivalent salt, anion and nonionic surfactants can be added to the latex mixture to stabilize the particle and reduce the shocking when a multivalent aggregating agent like PAC is added. PAC is also required to be added at room temperature (cold addition) to initiate aggregation in the presence of the pigment, since the addition of PAC at elevated temperature is typically not effective. However, when divalent salts such as zinc acetate are used as the aggregating agent, the agent is preferably added at elevated temperature, for example about 50 to 60° C. (hot addition) as opposed to cold addition. The primarily reason for this is that zinc acetate dissociates itself into the aqueous phase and the particle (pKa of zinc acetate is about 4.6). The dissociation is temperature dependent as well as pH dependent. When zinc acetate is added at elevated temperature, the temperature factor is minimized or eliminated. Furthermore, the amount of zinc acetate added can controlled to control the particle size, while in the case of cold addition of zinc acetate, neither of these parameters can be controlled. Furthermore, since the linear amorphous sulfonated polyester resin emulsion is prepared by dissolving or dissipating the resin at temperatures of about 60 to 70° C., it is ideal for the mixture to be heated to elevated temperature in order to prevent to the dissipation or dissolution of the polyester resin.

Thus, the process thus calls for blending the crystalline sulfonated polyester resin and the linear and/or branched amorphous sulfonated polyester resin emulsions, together in the presence of a pigment and optionally a wax or other additives, all comprising submicron particles, heating the blend from room temperature to about 60° C., followed by addition of addition of zinc acetate solution. The temperature may be slowly raised to 65° C. and held there for about 6 hrs to provide 9 micron particles the have a shape factor of, for example, about 115 to about 130 as measured on the FPIA Sysmex analyzer.

When a multivalent ion like PAC is used as the aggregating agent, it must be added cold as discussed above. Thus, the process steps are different than with zinc acetate, and calls for the addition of surfactants to the latex blend, followed by the addition of the pigment and optional additives. The surfactant stabilizes the particles by either electrostatic or steric forces or both, to prevent massive flocculation, when the aggregating agent is added. The pH of the blend containing the blend of toners, pigment, optional additives (wax), etc. is adjusted from about 5.6 to about 3.0 with 0.1 M nitric acid, followed by the addition of PAC, while being polytroned at speeds of about 5000 rpm. The temperature of the mixture is raised from room temperature to 55° C., and slowly in stages to about 65° C. in order to coalesce the particles.

It should be noted that no pH adjustment is required to stabilize the particle size in either of the two aggregating agent processes.

Following aggregation, the aggregates are coalesced. Coalescence may be accomplished by heating the aggregate mixture to a temperature that is about 5 to about 20° C. above the $T_g$ of the emulsion resin. Generally, the aggregated mixture is heated to a temperature of about 50 to about 80° C. In embodiments, coalescence is accomplished by also stirring the mixture at a temperature of from about 200 to about 750 revolutions per minute. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture is cooled to room temperature. After cooling, the mixture of toner particles is washed with water and then dried. Drying may be accomplished by any suitable method for drying including freeze drying. Freeze drying is typically accomplished at temperatures of about −80° C. for a period of about 72 hours.

The process may or may not include the use of surfactants, emulsifiers, and pigment dispersants.

Following formation of the toner particles, the aforementioned external additives may be added to the toner particle surface by any suitable procedure such as those well known in the art.

The present toners are sufficient for use in an electrostatographic or xerographic process. The present toners generally exhibit a minimum fixing temperature of from about 80 to about 130° C. The present toners exhibit satisfactory properties when used in a xerographic or electrostatographic process. Such properties include a high gloss, which may be in the range of from about 20 to about 60 Gardner gloss units, good C-zone and A-zone charging, a fusing latitude of 100° C. or more, and substantially no vinyl offset.

The toner particles of all embodiments are preferably formulated into a developer composition. Preferably, the toner particles are mixed with carrier particles to achieve a two-component developer composition. Preferably, the toner concentration in each developer ranges from, for example, 1 to 25%, more preferably 2 to 15%, by weight of the total weight of the developer.

Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like. Where toners of the present invention are to be used in conjunction with an image developing device employing roll fusing, the carrier core may preferably be at least partially coated with a polymethyl methacrylate (PMMA) polymer having a weight average molecular weight of 300,000 to 350,000, e.g., such as commercially available from Soken. The PMMA is an electropositive polymer in that the polymer that will generally impart a negative charge on the toner with which it is contacted. The coating preferably has a coating weight of from, for example, 0.1 to 5.0% by weight of the carrier, preferably 0.5 to 2.0% by weight. The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with from, for example, between about 0.05 to about 10 percent by weight, more preferably between about 0.05 percent and about 3 percent by weight, based on the weight of the coated carrier particles, of polymer until adherence thereof to the carrier core by mechanical impaction and/or electrostatic attraction. Various effective suitable means can be used to apply the polymer to the surface of the carrier core particles, e.g., cascade roll mixing, tumbling, milling, shaking, electrostatic powder cloud spraying, fluidized bed, electrostatic disc processing, and with an electrostatic curtain. The mixture of carrier core particles and polymer is then heated to enable the polymer to melt and fuse to the carrier core particles. The coated carrier particles are then cooled and thereafter classified to a desired particle size.

The carrier particles can be mixed with the toner particles in various suitable combinations. However, best results are obtained when about 1 part to about 5 parts by weight of toner particles are mixed with from about 10 to about 300 parts by weight of the carrier particles.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature just above the fusing temperature of the toner, i.e., to temperatures of from about 80° C. to about 150° C. or more.

Toner compositions and process for producing such toners according to the described embodiments are further illustrated by the following examples. The examples are intended to be merely further illustrative of the described embodiments.

Preparation of the Crystalline Polteser resin (CPE):

A crystalline linear sulfonated polyester resin comprised of 0.549 parts of sebacic acid, 0.051 parts of lithium sulfo-isophthalate and 0.400 parts of ethylene glycol was prepared as follows. In a two liter Hoppes reactor equipped with a heated bottom drain valve, high viscosity double turbine agitator, and distillation receiver with a cold water condenser was charged 900 grams of sebacic acid, 84 grams of lithium dimethylsulfoisophthalic acid, 655.2 grams of ethylene glycol, and 1.5 grams of butyltin hydroxide oxide as the catalyst. The reactor was heated to 190° C. with stirring for 3 hours and then heated to 210° C. over a one hour period, after which the pressure was slowly reduced from atmospheric pressure to about 260 Torr over a one hour period, and then reduced to 5 Torr over a two hour period, and the pressure was then further reduced to about 1 Torr over a 30 minute period. The polymer was discharged through the bottom drain onto a container full of ice water to yield 1000 grams of 3 mol % sulfonated polyester resin. The sulfonated polyester resin had a softening point of 93° C. (29 Poise viscosity measured by Cone & Plate Viscometer at 199° C.) and melting point range of 60 to 80° C. by differential scanning calorimetry (DSC). Emulsification of the resin in water was accomplished by dissolving the resin at 40° C. in acetone (20% solids loading) and adding this solution drop wise to water heated at 80° C. Using this process, the acetone is removed by distillation to result in a crystalline sulfonated polyester resin emulsion where the final solids loading is about 11%.

Preparation of Wax dispersion:

The aqueous wax dispersion was generated using RC 160 CARNUBA wax (from Toa Kasei, Japan) which was emulsified using NEOGEN RK™, an anionic surfactant/dispersant. The wax particle size was determined to be approximately 210 nm, and the wax slurry was supplied with a solid loading of 30 percent.

Preparation of Pigment dispersion:

The pigment dispersion utilized was an aqueous dispersion of Blue 15.3 pigment supplied from Sun Chemicals. The pigment dispersion contained an anionic surfactant and the pigment content of the dispersion supplied was 26.5 percent, 2 percent surfactant, and 71.5 percent water.

EXAMPLE 1

Preparation of a "Super Melt Toner"

951.27 grams of the crystalline polyester from Example 1 having a solids loading of 11.0% was blended with 17.2 g of the above pigment dispersion and 30.8 g of CARNUBA wax dispersion of 35% solids loading. To this mixture was added (i) 10 g of 20% anionic surfactant solution (1% by weight of solids) and 2 g (1.2% by weight of solids) of non-ionic surfactant (70% active ingredients). The pH of the resulting mixture was 5.5 as measured by an Orion pH meter. 4% nitric acid was added to the mixture to reduce the pH to about 4.0 while being sheared at speeds of 5000 rpm. To this was then added polyaluminum chloride (PAC) solution (3 g PAC/25 g $HNO_3$), thereby increasing the viscosity of the blend. 200 g of distilled water (DIW) was added to reduce the viscosity, allowing the blend to be manageable for shearing. The mixture was then heated to 55° C. and allowed to stir for 1 hr, followed by raising the temperature in stages by increments of 2° C. to a temperature of 65° C. The particle size obtained was 7.3 microns. The temperature was then increased slowly to 72° C. (above the melt point of the crystalline sulfonated polyester resin) and held there for a period of 3 hrs. The resulting particle size was 7.7 microns with a GSD of 1.26, and the resulting morphology was potato shaped with a smooth surface. The toner was cooled to room temperature and then washed 4 times with DIW and freeze dried. The final toner particle composition was 87.2% CPE, 3.8% pigment and 9% carnuba wax.

The dry toner was fused with a heated fuser roll. The gloss of the toner remained constant (40 ggu) throughout the fusing temperatures used, which was between the range of 105 to 215° C. and the MFT was determined to be about 90° C., or about 80° C. less than present sulfonated polyester resin toners that do not contain crystalline sulfonated polyester materials therein. The cohesion (blocking) of the toner was 12%, where less than 10% is considered extremely good.

EXAMPLE 2

Preparation of a "Super Melt Toner"

951.27 grams of the crystalline polyester from Example 1 having a solids loading of 11.0% was blended with 17.2 g of the above pigment dispersion and 30.8 g of CARNUBA wax dispersion of 35% solids loading. To this mixture was added (i) 15 g of 20% anionic surfactant solution (1% by weight of solids) and 2.5 g (1.2% by weight of solids) of non-ionic surfactant (70% active ingredients). The pH of the resulting mixture was 5.5 as measured by an Orion pH meter. 4% nitric acid was added to the mixture to reduce the pH to about 4.0 while being sheared at speeds of 5000 rpm. To this was then added polyaluminum chloride (PAC) solution (2.5 g PAC/25 g $HNO_3$), thereby increasing the viscosity of the blend. 200 g of distilled water (DIW) was added to reduce the viscosity, allowing the blend to be manageable for shearing. The mixture was then heated to 55° C. and allowed to stir for 1 hr, followed by raising the temperature in stages by increments of 2° C. to a temperature of 65° C. The particle size obtained was 10.0 microns. The temperature was then increased slowly to 72° C. (above the melt point of the crystalline sulfonated polyester resin) and held there for a period of 3 hrs. The resulting particle size was 11.0 microns with a GSD of 1.26, and the resulting morphology was potato shaped with a smooth surface. The toner was cooled to room temperature and then washed 4 times with DIW and freeze dried. The final toner particle composition was 87.2% CPE, 3.8% pigment and 9% carnuba wax.

The dry toner was fused with a heated fuser roll. The gloss of the toner remained constant (40 ggu) throughout the fusing temperatures used, which was between the range of 105 to 215° C. The fusing performance was found to be very similar to that of Example 1.

EXAMPLE 3

Preparation of Ultra Low Melt Toner (Amorphous/Crystalline)

A crystalline linear sulfonated polyester resin was prepared as in Example 1 above.

A linear amorphous sulfonated polyester emulsion was prepared as follows. Sulfonated polyester resin containing 3.75 moles of sulfonation was prepared by polycondensation reaction. The resin was ground into powder by milling. 1100 g of the resin powder was added to 10 liters of water in a reactor and stirred at a speed of 500 rpm with a pitch blade turbine. The temperature of the reactor was raised to 85° C. and allowed to stir for a period of 1 hr in order to dissipate the resin into an emulsion comprising linear amorphous sulfonated polyester resin particles having an average size of about 25 nm suspended in water. The reactor was then cooled down to room temperature and the emulsion discharged. The emulsion comprised 12.6 weight percent resin and 87.4 weight percent water.

The pigment dispersion utilized was an aqueous dispersion of Blue 15.3 pigment supplied from Sun Chemicals. The pigment dispersion contained an anionic surfactant and the pigment content of the dispersion supplied was 26.5 percent, 2 percent surfactant, and 71.5 percent water.

367.3 grams of the crystalline sulfonated polyester having a solids loading of 11.0% was blended with 595.5 grams of the linear amorphous sulfonated polyester resin emulsion and 17.2 g of the above pigment dispersion. The mixture was heated to 60° C. 3% zinc acetate solution (3 g of zinc acetate/97 g of water) was added at the rate of 10 ml/min and the temperature raised to 62° C. The mixture was allowed to aggregate for a period of 3 hrs and the particle size monitored. Another 2% aqueous zinc acetate (2 g in 98 g of water) was added to promote particle growth. The mixture was allowed to stir overnight at 64° C. The particle size as measured on the coulter multisizer III was found to be 9.microns with a GSD of 1.16, and the particles were largely spherical in shape. The mixture was cooled to room temperature and washed 3 times with DIW at room temperature. The toner had a final binder ratio of 65% linear amorphous sulfonated polyester and 35% crystalline sulfonated polyester. A fusing evaluation using a heated fuser roll found that the toner had a MFT of about 110° C., or about 60° C. less than present sulfonated polyester resin toners that do not contain crystalline sulfonated polyester materials therein.

Although the invention has been described with reference to specific preferred embodiments, it is not intended to be limited thereto. Rather, those having ordinary skill in the art will recognize that variations and modifications may be made therein which are within the spirit of the invention and within scope of the claims.

What is claimed is:

1. A toner comprising a toner binder comprised of crystalline sulfonated polyester, a linear amorphous sulfonated polyester, a branched amorphous sulfonated polyester and a colorant.

2. The toner according to claim 1, wherein the crystalline sulfonated polyester comprises from about 20% to about 50% by weight of the toner binder and the linear amorphous sulfonated polyester comprises from about 40% to about 80% by weight of the toner binder.

3. The toner according to claim 1, wherein the branched sulfonated polyester is present in an amount replacing up to 80% of the linear amorphous sulfonated polyester.

4. The toner according to claim 1, wherein the toner has a minimum fixing temperature of from about 100° C. to about 130° C. and a fusing latitude of 100° C. or more.

5. The toner according to claim 1, wherein the toner has an average particle size of about 7 to about 11 microns and a geometric size distribution of about 1.10 to about 1.25.

6. A method comprising:

forming an emulsion comprising a linear amorphous sulfonated polyester resin, a branched amorphous sulfonated polyester resin and a crystalline sulfonated polyester resin;

forming a pre-toner mixture by adding a colorant and optionally a wax to the emulsion;

homogenizing the pre-toner mixture;

adding an aggregating agent to the pre-toner mixture and aggregating the mixture to form aggregated toner particles; and coalescing the aggregated toner particles to form coalesced toner particles.

7. The method according to claim 6, wherein the aggregating agent comprises a multivalent salt; the aggregating agent is added to the mixture at room temperature; and at least one surfactant is also added to the mixture.

8. The method according to claim 6, wherein the aggregating agent comprises a divalent salt; and the aggregating agent is added after the temperature of the mixture is raised to an elevated temperature by heating to above room temperature.

9. The method according to claim 8, wherein the elevated temperature is about 50° C. to about 60° C.

10. The method according to claim 8, wherein a wax is also added to the mixture.

11. The method according to claim 6, wherein the aggregating agent comprises a polyaluminum halide, a polyaluminum silicate, or a water soluble metal salt selected from the group consisting of aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof.

12. The method according to claim 6, wherein when the aggregating agent is a multivalent salt, the aggregating agent is added in an amount of about 0.05 pph to about 3.0 pph by weight of the toner and when the aggregating agent is a divalent salt, the aggregating agent is added in an amount of from about 1.0 to about 10 pph by weight of the toner.

* * * * *